US010688641B2

(12) United States Patent
Weigmann et al.

(10) Patent No.: US 10,688,641 B2
(45) Date of Patent: Jun. 23, 2020

(54) DRIVING TOOL FOR DRIVING FASTENING MEANS INTO A WORKPIECE

(71) Applicant: ILLINOIS TOOL WORKS INC., Glenview, IL (US)

(72) Inventors: Torsten Weigmann, Ronnenberg (DE); Klaus Von Soest, Winzenburg (DE); Olaf Haehndel, Plattensen (DE)

(73) Assignee: Illinois Tool Works Inc., Glenview, IL (US)

( * ) Notice: Subject to any disclaimer, the term of this patent is extended or adjusted under 35 U.S.C. 154(b) by 552 days.

(21) Appl. No.: 14/898,212

(22) PCT Filed: Apr. 23, 2014

(86) PCT No.: PCT/US2014/035108
§ 371 (c)(1),
(2) Date: Dec. 14, 2015

(87) PCT Pub. No.: WO2014/209481
PCT Pub. Date: Dec. 31, 2014

(65) Prior Publication Data

US 2016/0136797 A1 May 19, 2016

(30) Foreign Application Priority Data

Jun. 25, 2013 (DE) ..... 10 2013 106 658

(51) Int. Cl.
*B25C 1/00* (2006.01)
*B25C 1/04* (2006.01)
*B25C 1/06* (2006.01)

(52) U.S. Cl.
CPC ..... *B25C 1/008* (2013.01); *B25C 1/04* (2013.01); *B25C 1/06* (2013.01)

(58) Field of Classification Search
CPC .. B25C 1/00; B25C 1/008; B25C 1/06; B25C 1/047; B25C 1/04; B25C 1/041;
(Continued)

(56) References Cited

U.S. PATENT DOCUMENTS 3,467,294 A 9/1969 Fisher
3,479,926 A 11/1969 Hillier
(Continued)

FOREIGN PATENT DOCUMENTS

CN 1788940 A 6/2006
CN 101284374 10/2008
(Continued)

OTHER PUBLICATIONS

ISR and WO for PCT/US2014/035108 dated Aug. 11, 2014, 11 pages.

*Primary Examiner* — Alexander M Valvis
*Assistant Examiner* — Katie L Gerth
(74) *Attorney, Agent, or Firm* — Neal, Gerber & Eisenberg LLP

(57) ABSTRACT

This relates to a driving tool for driving fastening means, nails/staples, into a workpiece, a trigger lever, which can be actuated manually, and a workpiece contact element, which can be actuated by placing the tool onto the workpiece, the tool operates in a single shot mode, in which each individual sequence of an actuation of the workpiece contact element with subsequent actuation of the trigger lever triggers a driving-in cycle, the tool operates in a bump firing mode, in which, with the trigger lever continuously actuated, each individual actuation of the workpiece contact element triggers a driving-in cycle, a resetting assembly providing, by means of which the tool is resettable from the bump firing mode into single shot mode in an automatic, time-controlled resetting operation. It is proposed that a signaling assembly,
(Continued)

which emits a feedback signal to the user before, after or during each automatic resetting operation, is provided.

5 Claims, 4 Drawing Sheets

(58) Field of Classification Search
CPC B25C 1/043; B25C 5/13; B25B 25/15; G06F 3/016
USPC ..... 227/8
See application file for complete search history.

(56) References Cited

U.S. PATENT DOCUMENTS 3,572,572 A 3/1971 Readyhough et al.
35,725,572 3/1971 Readyhough
3,580,455 A 5/1971 Cast
3,583,496 A 6/1971 Fehrs
3,786,978 A 1/1974 Manganaro
3,964,659 A * 6/1976 Eiben ..... B25C 1/008 227/8
4,351,464 A 9/1982 Fehrs
4,550,643 A 11/1985 Schwartzenberger
4,679,719 A 7/1987 Kramer
5,191,861 A 3/1993 Kellerman et al.
5,197,646 A 3/1993 Nikolich
5,551,620 A 9/1996 Vallee
5,605,268 A 2/1997 Hayashi et al.
5,687,897 A 11/1997 Fa
5,732,870 A 3/1998 Moorman et al.
5,772,096 A 6/1998 Osuka et al.
5,862,969 A 1/1999 Lee
5,918,788 A 7/1999 Moorman et al.
6,095,392 A 8/2000 Batts, Jr.
6,123,241 A * 9/2000 Walter ..... B25C 1/08 123/46 SC
6,213,372 B1 4/2001 Chen
6,357,647 B1 3/2002 Ou
6,371,348 B1 4/2002 Canlas et al.
6,382,492 B1 5/2002 Moorman et al.
6,431,425 B1 8/2002 Moorman et al.
6,450,387 B1 9/2002 Chen
6,543,664 B2 4/2003 Wolfberg
6,604,664 B2 * 8/2003 Robinson ..... B25C 1/008 227/120
6,691,907 B1 2/2004 Chang
6,695,193 B1 2/2004 Chang
6,695,194 B1 2/2004 Chang
6,857,547 B1 2/2005 Lee
7,070,080 B2 7/2006 Lin
7,143,918 B2 12/2006 Aguirre et al.
7,163,134 B2 1/2007 Moeller et al.
7,191,927 B2 3/2007 Segura
7,196,688 B2 * 3/2007 Schena ..... G01D 7/007 345/156
7,383,974 B2 6/2008 Moeller
7,469,811 B2 12/2008 Shima et al.
7,469,818 B2 12/2008 Saltsor et al.
7,510,105 B2 3/2009 Moeller et al.
7,513,402 B2 4/2009 Miyashita
7,828,072 B2 11/2010 Hashimoto et al.
7,938,305 B2 5/2011 Simonelli et al.
7,971,766 B2 7/2011 Tang
7,975,890 B2 7/2011 Tang
8,011,441 B2 9/2011 Leimbach et al.
8,011,547 B2 9/2011 Leimbach et al.
8,215,528 B2 7/2012 Matsunaga et al.
8,313,012 B2 * 11/2012 Shima ..... B25C 1/06 173/117
8,336,749 B2 12/2012 Largo
8,348,118 B2 1/2013 Segura
9,061,407 B2 6/2015 Chien et al.
9,242,359 B2 1/2016 Staples
9,381,663 B2 7/2016 Maurer
9,486,907 B2 11/2016 Birk
9,550,288 B2 1/2017 Moore et al.
9,782,879 B2 10/2017 Baur
9,782,880 B2 10/2017 Moore et al.
10,213,911 B2 2/2019 Moore et al.
2001/0006183 A1 7/2001 Mukoyama
2002/0130154 A1 9/2002 Wolfberg
2002/0185514 A1 12/2002 Adams et al.
2003/0121947 A1 7/2003 Hsu
2004/0045997 A1 * 3/2004 Birk ..... B25C 1/008 227/2
2005/0023318 A1 2/2005 Aguirre et al.
2005/0029323 A1 2/2005 Shima
2005/0173484 A1 8/2005 Moeller
2005/0173487 A1 8/2005 Moeller et al.
2005/0217874 A1 * 10/2005 Forster ..... B25C 1/06 173/1
2005/0217875 A1 10/2005 Forster et al.
2005/0220445 A1 10/2005 Baskar
2007/0004984 A1 * 1/2007 Crum ..... A61B 8/06 600/471
2007/0131731 A1 6/2007 Moeller
2007/0278275 A1 * 12/2007 Ho ..... B25C 1/008 227/8
2008/0073405 A1 3/2008 Shima
2008/0251558 A1 10/2008 Suda
2009/0057365 A1 3/2009 Murayama
2009/0159633 A1 * 6/2009 Wu ..... B25C 1/008 227/8
2009/0236387 A1 * 9/2009 Simonelli ..... B25C 1/008 227/8
2009/0242604 A1 10/2009 Mina
2009/0250500 A1 10/2009 Brendel
2009/0314818 A1 12/2009 Segura
2010/0116863 A1 5/2010 Suda
2010/0173686 A1 * 7/2010 Grant ..... A63F 13/06 463/2
2010/0236911 A1 * 9/2010 Wild ..... H01H 3/022 200/345
2010/0237124 A1 9/2010 Shima
2010/0243699 A1 9/2010 Largo
2012/0022525 A1 * 1/2012 Dietz ..... A61B 17/32 606/45
2012/0041436 A1 * 2/2012 Ullrich ..... A61B 18/12 606/39
2012/0097730 A1 4/2012 Liang et al.
2012/0104070 A1 * 5/2012 Wu ..... B25C 1/008 227/8
2012/0118932 A1 5/2012 Largo
2012/0138658 A1 * 6/2012 Ullrich ..... A61B 17/072 227/175.1
2012/0298390 A1 11/2012 Schieler
2013/0041368 A1 * 2/2013 Cunningham ..... A61B 18/14 606/34
2013/0062390 A1 * 3/2013 Yeh ..... B25C 1/047 227/8
2017/0050305 A1 2/2017 Birk
2019/0184536 A1 6/2019 Moore et al.

FOREIGN PATENT DOCUMENTS

CN 101743099 A 6/2010
DE 202013001537 3/2013
EP 0736360 A2 10/1996
EP 1223009 7/2002
EP 1240982 9/2002
EP 1980367 A2 10/2008
EP 2450152 A2 5/2012
EP 2450152 9/2012
JP H08276375 10/1996
JP 2002346946 A 12/2002
WO 02051591 A1 7/2002
WO WO 02/051591 7/2002

* cited by examiner

DRIVING TOOL FOR DRIVING FASTENING MEANS INTO A WORKPIECE

RELATED APPLICATIONS

The present application is a National Phase of International Application Number PCT/US2014/035108 filed Apr. 23, 2014 and claims priority to German Application Number 10 2013 106 658.5 filed Jun. 25, 2013.

BACKGROUND

The present invention relates to a driving tool for driving fastening means into a workpiece and to a method for operating such a driving tool.

The driving tool in question is used primarily as a handheld tool, for example for fastening particle boards on supporting structures. The term "fastening means" should be understood here in a broad sense and comprises not only nails and staples but also screws, pins or the like. The main focus of attention here is on the driving in of nails, which should not be understood as being restrictive.

The fastening means usually take the form of a magazine belt. Depending on the design, the magazine belt may for example have a carrier belt of plastic or metal, which carries the individual fastening means. Another variant is that of providing a series of parallel running fastening wires, which are tacked on to the individual fastening means.

The driving tool in question may be designed as a compressed-air-operated driving tool, as a combustion-powered driving tool or as an electrically operated driving tool or the like.

The known driving tool (U.S. Pat. No. 6,604,664 B2), on which the invention is based, is designed as a compressed-air-operated driving tool. It is provided with a pneumatic actuator unit, which serves for driving in the fastening means in individual driving-in cycles.

For triggering the driving-in cycles of the pneumatic actuator unit, a triggering assembly is provided, having a trigger lever that can be actuated manually and a workpiece contact element that can be actuated by placing the driving tool onto the workpiece.

What is advantageous about the known driving tool is the fact that it can be operated in two different operating modes. In the single shot mode, each individual sequence of an actuation of the workpiece contact element (from the unactuated state of the workpiece contact element) with subsequent actuation of the trigger lever (from the unactuated state of the trigger lever) triggers a driving-in cycle. In the bump firing mode, with the trigger lever continuously actuated, each individual actuation of the workpiece contact element (in each case from the unactuated state) triggers a driving-in cycle.

In the case of the known driving tool, a resetting from the bump firing mode into the single shot mode is provided in an automatic, time-controlled resetting operation. For this, the driving tool has a resetting assembly with a control volume. The resetting assembly can be activated in the bump firing mode, by air at a working pressure being admitted into the control volume. The control volume is provided with an air-venting opening, which allows slow venting of the air. If the pressure goes below a limit value, this has the effect after a predetermined delay time of transferring the driving tool into the single shot mode. A separate valve, the valve piston of which is coupled to the workpiece contact element, is provided for the activation of the resetting assembly. An actuation of the workpiece contact element consequently leads to an activation of the resetting assembly. This is intended to achieve the effect that, when the driving tool is not used over a certain delay time, there is a correspondingly automatic, time-controlled resetting of the driving tool from the bump firing mode into the single shot mode in a resetting operation.

SUMMARY

The invention addresses the problem of designing and developing the known driving tool in such a way that user convenience, with regard to the automatic resetting operation, is further increased.

The above problem is solved in the case of a driving tool according to some embodiments.

Essential to this is the fundamental consideration that informing the user about a resetting operation that is pending, is in progress or has taken place, which of course takes place in a time-controlled manner and to that extent automatically, leads to an increase in user convenience. For example, this makes it possible to avoid the situation in which the user places the driving tool onto a tool, with the trigger lever actuated, after the automatic resetting operation has already taken place. To be precise, this would have the effect, surprisingly for the user, that the placing of the driving tool, and the associated actuation of the workpiece contact element, would not be accompanied by a fastening means being driven in, since the driving device is already in the single shot mode.

It is specifically proposed that a signaling assembly, which emits a feedback signal to the user before, after or during each automatic resetting operation, is provided. In the simplest case, the feedback signal makes the user aware that the resetting operation is taking place or has already taken place. On this basis, the user can decide whether to continue operating in single shot mode or to transfer the driving tool to bump firing mode.

In a preferred alternative, the signaling assembly emits a feedback signal at a predetermined time interval before the automatic resetting operation. In this way, the user can be warned that the resetting operation is pending. The user can then decide, for example, to start a further driving-in cycle, in order to remain in bump firing mode.

The feedback signal that can be emitted by the signaling assembly may preferably be an optical signal, an acoustic signal or a haptic signal. A combination of these various types of signal is also conceivable.

According to a further teaching, which is likewise of independent significance, a method for operating the driving tool is disclosed.

What is essential according to this further teaching is that a signaling assembly explained above, by means of which a feedback signal is emitted to the user before, after or during each resetting operation, is provided. Reference may be made to all of the statements made in relation to the operation of the driving tool as proposed.

BRIEF DESCRIPTION OF THE DRAWINGS

The invention is explained in more detail below on the basis of drawings that merely shows exemplary embodiments. In the drawings.

In the figures, the same reference signs/numerals are used for identical or similar components, even if a repeated description is omitted for reasons of simplicity.

DETAILED DESCRIPTION

Figure 1:
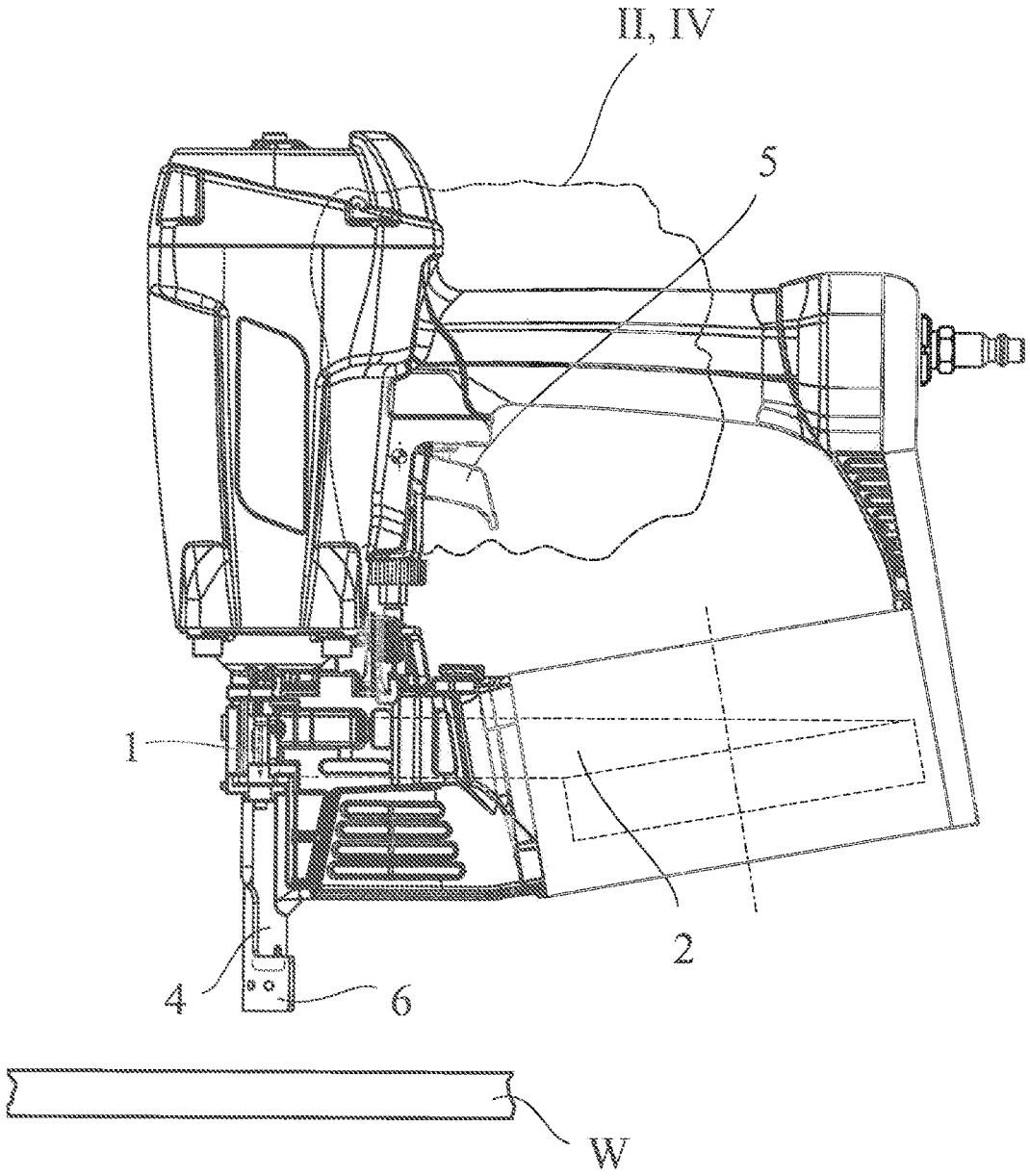
FIG. 1 shows a driving tool as proposed, in a side view.

The driving tool that is represented in the drawing serves for driving in fastening means 1 of a magazine belt 2 indicated in FIG. 1, in particular nails, staples or the like. With regard to further interpretation of the term "fastening means", reference may be made to the introductory part of the description.

The driving in of nails is the main focus of attention in the description that follows, which should not be understood as being restrictive. All statements that are made with respect to nails apply correspondingly to all other types of fastening means that can be driven in.

The driving tool is a compressed-air driving tool with a pneumatic actuator unit 3 schematically represented in the drawing, by means of which the fastening means 1 can be driven into the workpiece W in driving-in cycles. In a driving-in cycle, the fastening means 1, driven by the pneumatic actuator unit 3, pass through a driving channel 4 into the workpiece W.

The driving tool as proposed also has a trigger lever 5, which can be actuated manually. The trigger lever 5 represented in the drawing can be pivoted about a trigger lever axis 5*a* for actuation.

In order to avoid unintentional triggering of driving-in cycles, also provided is a workpiece contact element 6, which can be actuated by the placing of the workpiece contact element 6 onto the workpiece W. The workpiece contact element 6 can be resiliently deflected upward in FIG. 1 for actuation.

The driving tool can be operated in different operating modes, depending on the application. Firstly, the driving tool can be operated in a single shot mode, in that each individual sequence of an actuation of the workpiece contact element 6, with subsequent actuation of the trigger lever 5, triggers a driving-in cycle. In the single shot mode, the user therefore first places the driving tool onto the workpiece W, thereby actuating the workpiece contact element 6, and subsequently actuates the trigger lever 5. This sequence leads to the triggering of the driving-in cycle. If the fastening means 1 are to be driven in at a multiplicity of driving-in locations lying next to one another, the driving tool can be advantageously operated in bump firing mode. In bump firing mode, with the trigger lever 5 continuously actuated, each individual actuation of the workpiece contact element 6 triggers a driving-in cycle. If the user keeps the trigger lever 5 actuated, the placing of the driving tool, and consequently the actuation of the workpiece contact element 6, is sufficient for the triggering of a driving-in cycle.

It is preferably the case that the completely unactuated driving tool is initially in the single shot mode. This means that, for triggering the first driving-in cycle, first the workpiece contact element 6 and then the trigger lever 5 must be actuated. After this first driving-in cycle, the driving tool is preferably in the bump firing mode. The user then has the possibility of keeping the trigger lever 5 actuated and triggering a further driving-in cycle with each actuation of the workpiece contact element 6.

The handling of the driving tool as proposed is made particularly convenient by providing a resetting assembly 7 that is schematically represented in the drawings, by means of which the driving tool can be reset from the bump firing mode into the single shot mode in an automatic, time-controlled resetting operation. This means that such a resetting operation is automatically initiated in accordance with a certain specification, on the basis of a time control, for example on the basis of a specific time sequence. Correspondingly, the resetting assembly 7 is provided with a time-control device of some kind or other.

It is therefore essential to provide a signaling assembly 8, which is likewise only schematically represented in the drawing and which emits a feedback signal to the user before, after or during each automatic resetting operation that is initiated by the resetting assembly 7. Consequently, depending on the design, it is possible for the user to be informed simply as to whether an automatic resetting operation is pending, has already taken place or is in the process of taking place.

Numerous advantageous variants are conceivable for the structural design of the resetting assembly 7. It is preferably the case that the resetting assembly 7 can be activated in the bump firing mode and, after a delay time starting from the activation, has the effect of automatically transferring the driving tool from the bump firing mode into the single shot mode.

The activation of the resetting assembly 7 is possible in various ways. Here and preferably, the resetting assembly 7 is coupled to a pneumatic actuator unit 3, by means of which the fastening means 1 can be driven into the workpiece W in driving-in cycles, a driving-in cycle activating the resetting assembly 7 in bump firing mode. It may alternatively be provided that the resetting assembly 7 can be activated by a predetermined actuation of the trigger lever 5 and/or of the workpiece contact element 6, for example by the workpiece contact element 6 coming away from a workpiece W.

To sum up, an automatic resetting operation preferably takes place after a delay time starting from the last driving-in cycle or after a delay time starting from the last user actuation and directed at triggering a driving-in cycle.

In principle, it may be provided that the signaling assembly 8 emits a feedback signal during every resetting operation that is initiated by the resetting assembly 7. This makes it clear to the user that the driving tool has been reset to the single shot mode. In the case of a particularly preferred design, it is however the case that the signaling assembly 8 emits a feedback signal at a predetermined time interval before the resetting operation.

This allows the user to respond, for example in that, with the trigger lever 5 actuated, the user actuates the workpiece contact element 6 and thereby triggers a further driving-in cycle. Consequently, the resetting assembly 7 described above involves renewed activation of the resetting assembly 7, and so the driving tool at first remains in the bump firing mode. Alternatively or in addition, it may be provided that the signaling assembly 8 emits a feedback signal at a predetermined time interval after the resetting operation. This would inform the user that the resetting operation has been safely completed.

Depending on the application, it may also be advantageous that the signaling assembly 8 emits a differing feedback signal, depending on the time interval from the resetting operation. For example, the signaling assembly 8 could emit a cyclical signal, the cycle time of which is continuously reduced as the resetting operation approaches.

A particularly low-cost structure can be achieved by the signaling assembly 8 being operated electrically. Numerous electrically operated variants for the emission of a feedback signal are known.

In a particularly preferred design, the driving tool is operated electrically, the signaling assembly 8 being operated by the voltage supply of the driving tool. Alternatively, the signaling assembly 8 may also be assigned a separate voltage supply, in particular a battery assembly or the like.

It is also advantageous that the signaling assembly 8 is operated pneumatically. This is advantageous in particular if the driving tool itself is operated pneumatically, the signaling assembly 8 preferably relying on the compressed air supply of the driving tool.

Figure 4:
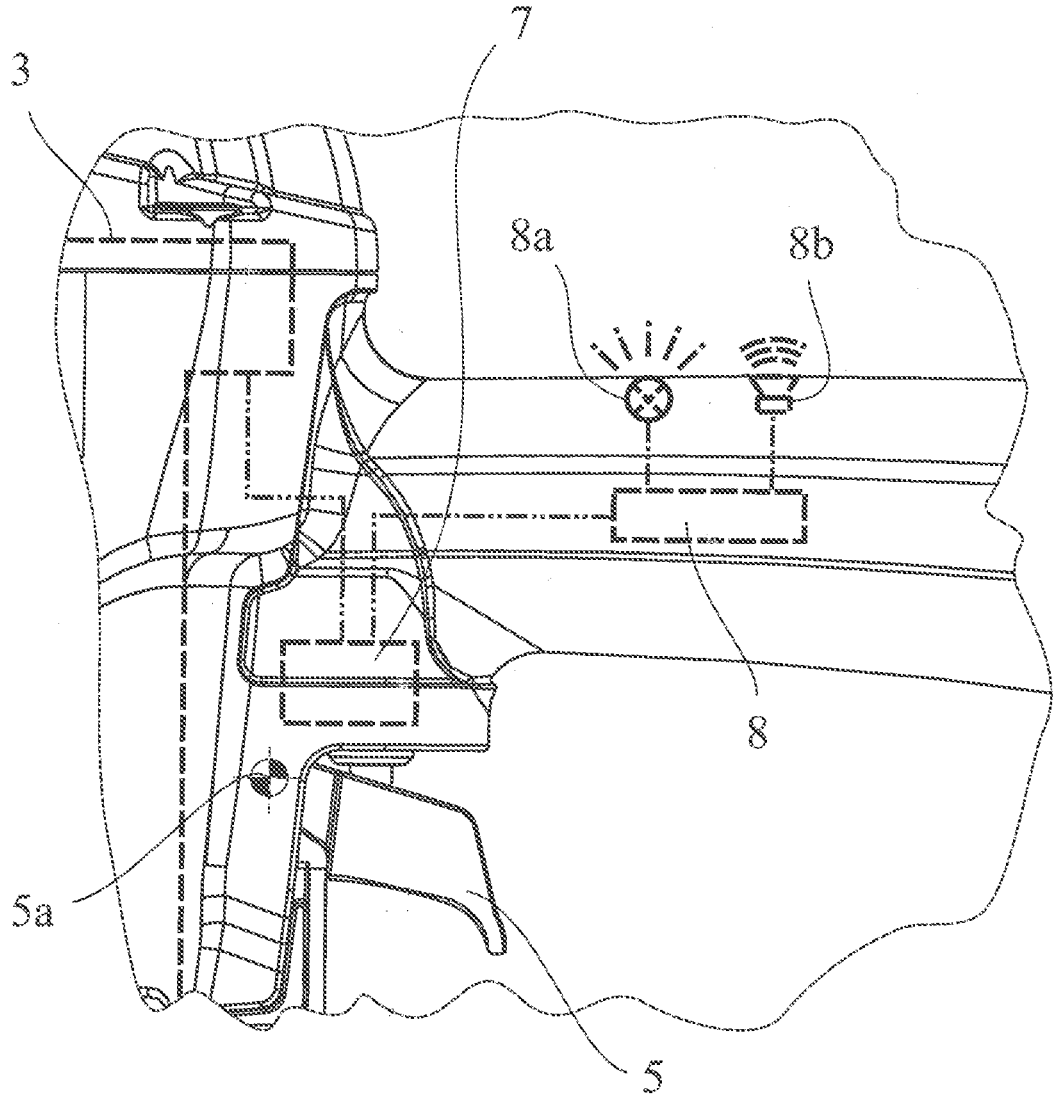
FIG. 4 shows a driving tool according to FIG. 1 in a further embodiment, in the view of a detail IV.

Depending on the application, completely different variants are conceivable for the feedback signal of the signaling assembly 8. For example, the feedback signal may be an optical signal (FIG. 4). It is then preferably the case that the signaling assembly 8 has a corresponding light source 8*a*. The light source 8*a* may be, for example, a light-emitting diode assembly or the like. Alternatively, the signaling assembly 8 may have a mechanical display. For example, the signaling assembly 8 may have a display element, in particular, a colored display element, which can be presented in a display window.

Alternatively or in addition, however, it may also be the case that the feedback signal that can be emitted by the signaling assembly 8 is an acoustic signal, the signaling assembly preferably having for this a sound generator 8*b* (FIG. 4). Such a sound generator may be an electrical buzzer, an electrical loudspeaker, a pneumatic whistling assembly or the like.

Figure 2:
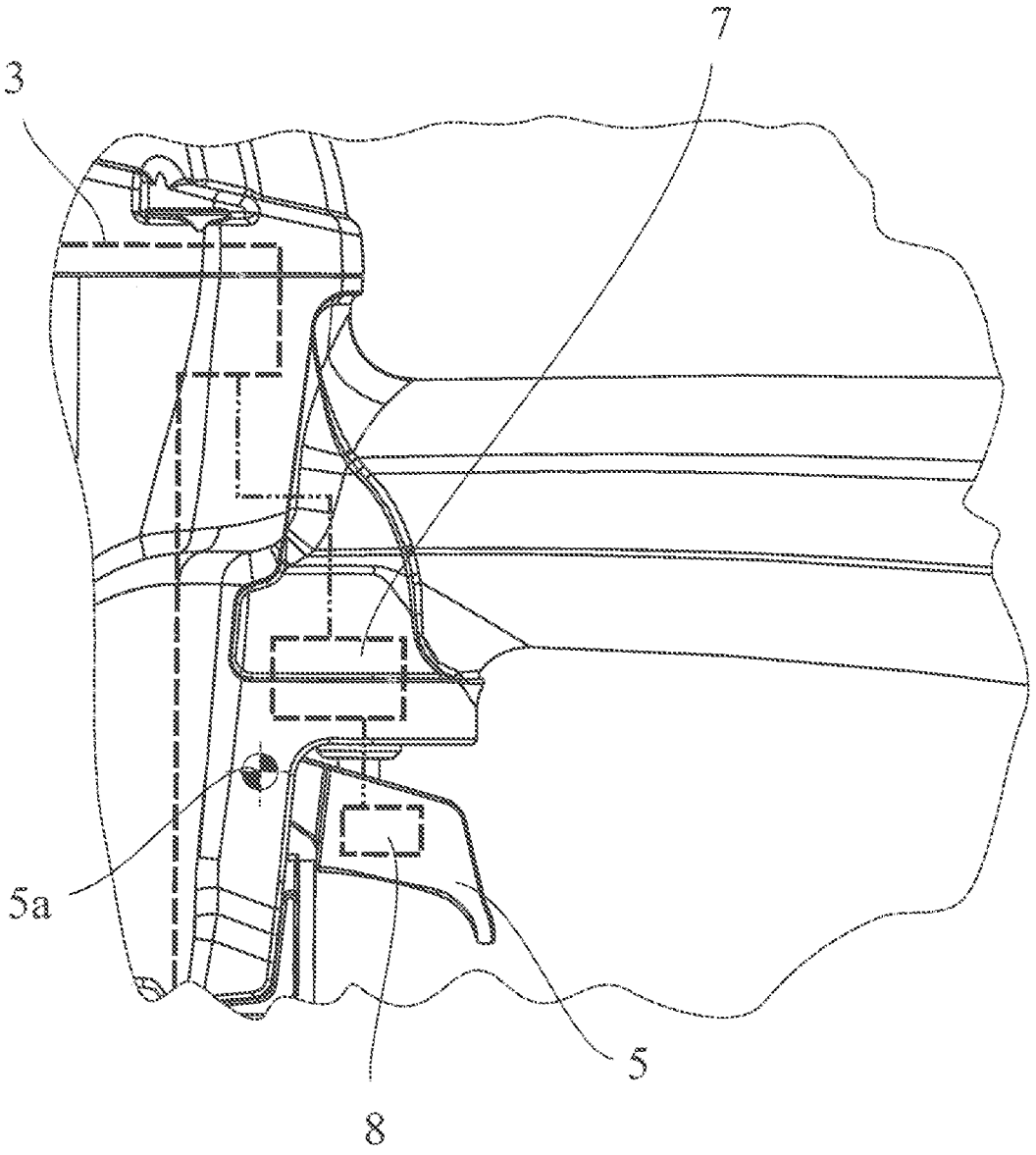
FIG. 2 shows the driving tool according to FIG. 1, in the view of a detail II.
Figure 3:
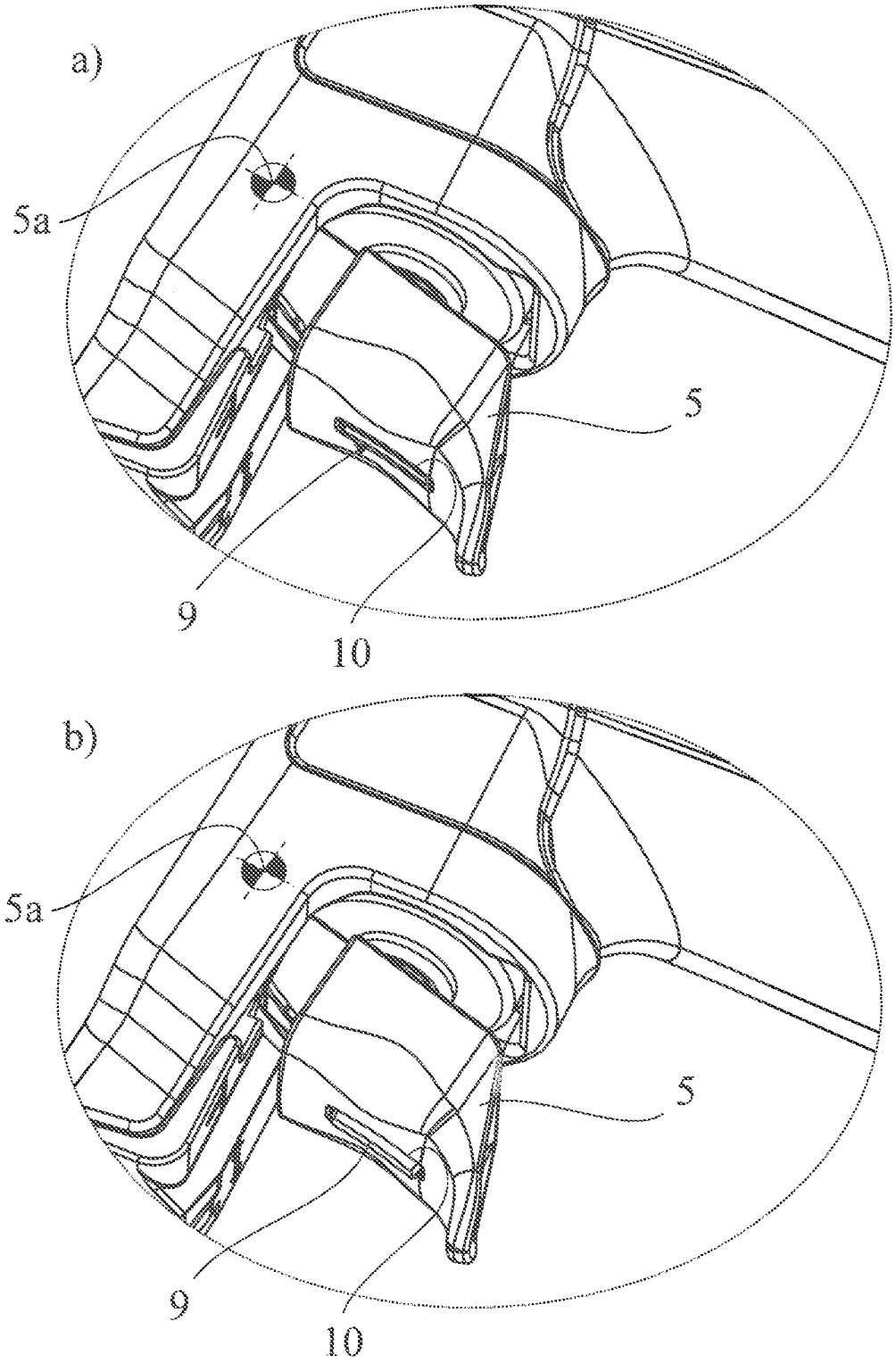
FIG. 3 shows the trigger lever of the driving tool according to FIG. 1 a) in the actuated state without the feedback signal from the signaling assembly, and b) in the actuated state with the feedback signal from the signaling assembly

In a particularly preferred design, however, it is the case that the feedback signal that can be emitted by the signaling assembly 8 is a haptic signal (FIGS. 1-3). In this case, the signaling assembly 8 preferably has a signaling movement drive for generating a tangible signaling movement, a signaling pulse generator for generating a tangible signaling pulse or a signaling vibrator for generating a tangible signaling vibration.

The above, haptic signals of the signaling assembly 8 can be felt best by the user when the signaling assembly 8 is at least partly integrated in the trigger lever 5.

The signaling assembly 8 advantageously has a feeling element 9, which can be adjusted for the emission of a haptic feedback signal and can be seen in the representation according to FIG. 3. In this case, the feeling element 9 is preferably integrated in the trigger lever 5, as the representation according to FIG. 3 likewise shows. In the case of the exemplary embodiment represented in FIG. 3, the feeling element 9 is adjustable with respect to the trigger lever 5 for the emission of the haptic feedback signal.

Specifically, the trigger lever 5 forms a receptacle for the feeling element 9, the feeling element 9 protruding through an opening 10 in the trigger lever 5, at least for the emission of a feedback signal. This is evident from viewing FIGS. 3*a*) and 3*b*) together. In FIG. 3*a*), the signaling assembly 8 is not yet emitting a feedback signal. In FIG. 3*b*), the signaling assembly 8 is emitting a feedback signal, in that the feeling element 9 is made to project through the slit-like opening 10 in the trigger lever 5. For this, the feeling element 9 is preferably coupled to an aforementioned signaling movement drive.

A particularly simple structure is obtained, however, by the signaling assembly 8 being a component part of the resetting assembly 7, in particular if the signaling assembly 8 serves for generating haptic feedback signals. This is attributable to the consideration that the resetting assembly 7 must in any case implement an adjusting movement of some kind or other for the implementation of the resetting operation, and this can be used for generating the haptic feedback signals.

Specifically, the resetting assembly 7 is preferably provided with a resetting element, which is adjusted into a resetting position for the resetting of the driving device into the single shot mode, the adjustment of the resetting element into the resetting position being triggered by generation of the feedback signal. The adjustment of the resetting element into the resetting position preferably brings about a corresponding adjustment of the feeling element 9, here and preferably through the slit-like opening 10 in the trigger lever 5, as a feedback signal.

According to a further teaching, which is of independent significance, a method for operating a driving tool as proposed is disclosed.

The driving tool correspondingly has a trigger lever 5, which can be actuated manually, and a workpiece contact element 6, which can be actuated by placing the driving tool onto the workpiece W, and can be operated in a single shot mode and in a bump firing mode. Also provided is a resetting assembly 7, by means of which the driving tool is reset from the bump firing mode into the single shot mode in a time-controlled resetting operation.

What is essential according to the further teaching is that a signaling assembly 8 is provided, by means of which a feedback signal is emitted to the user before, after or during every resetting operation. Reference may be made to all of the statements made with respect to the operation of the driving tool as proposed.

The invention claimed is:

1. A driving tool for driving a fastener into a workpiece, the driving tool comprising:

a trigger lever, which is configured to be actuated manually;

a workpiece contact element, which is configured to be actuated by placing the driving tool onto the workpiece, wherein the driving tool is operable in a single shot mode, in which each individual sequence of an actuation of the workpiece contact element with subsequent actuation of the trigger lever triggers a driving-in cycle, and the driving tool is further operable in a bump firing mode, in which, with the trigger lever continuously actuated, each individual actuation of the workpiece contact element triggers a driving-in cycle;

a resetting assembly, by means of which the driving tool is configured to be reset from the bump firing mode into the single shot mode in an automatic, time-controlled resetting operation; and, a signaling assembly, which is configured to emit a feedback signal to the user before, after or during the automatic, time-controlled resetting operation;

wherein, the resetting assembly is configured to be activated in the bump firing mode and, after a delay time starting from the activation, transfer the driving tool from the bump firing mode into the single shot mode;

wherein the signaling assembly and the driving tool are operable pneumatically, wherein the feedback signal that is configured to be emitted by the signaling assembly is a haptic signal at the trigger lever, wherein the signaling assembly has a feeling element that is movable relative to the trigger lever in order to produce the haptic feedback signal, wherein the trigger lever includes a through opening through which the feeling element moves in order to project forwardly of a front surface of the trigger lever to produce the haptic feedback signal;

wherein the resetting assembly further comprises a resetting element, which is adjustable into a resetting position for the resetting of the driving tool into the single shot mode, and the adjustment of the resetting element into the resetting position is triggered by generation of the feedback signal.

2. The driving tool as claimed in claim 1, wherein the signaling assembly is configured to emit the feedback signal at a predetermined time interval before the automatic, time-controlled resetting operation.

3. The driving tool as claimed in claim 1, wherein the adjustment of the resetting element into the resetting position brings about movement of the feeling element.

4. A driving tool for driving a fastener into a workpiece, the driving tool comprising:

a trigger lever, which is configured to be actuated manually;

a workpiece contact element, which is configured to be actuated by placing the driving tool onto the workpiece, wherein the driving tool is operable in a single shot mode, in which each individual sequence of an actuation of the workpiece contact element with subsequent actuation of the trigger lever triggers a driving-in cycle, and the driving tool is further operable in a bump firing mode, in which, with the trigger lever continuously actuated, each individual actuation of the workpiece contact element triggers a driving-in cycle;

a resetting assembly for resetting the driving tool from the bump firing mode into the single shot mode in an automatic, time-controlled resetting operation; and a signaling assembly, which is configured to emit a feedback signal to the user before, after or during the automatic, time-controlled resetting operation, wherein the signaling assembly includes a feeling element and the feedback signal is a haptic signal that is generated by movement of the feeling element toward the trigger lever;

wherein the trigger lever forms a receptacle for the feeling element;

wherein a front surface of the trigger lever includes a through opening in communication with the receptacle, and the feeling element protrudes through the through opening and forwardly of the front surface in order to produce the haptic signal;

wherein the resetting assembly further comprises a resetting element, which is adjustable into a resetting position for resetting the driving tool from the bump firing mode into the single shot mode, and the adjustment of the resetting element into the resetting position is triggered by generation of the feedback signal.

5. The driving tool of claim 4, wherein the through opening is a slit opening.

* * * * *